United States Patent [19]

Fehr

[11] Patent Number: 4,572,415

[45] Date of Patent: Feb. 25, 1986

[54] CARRIER FOR A REVOLVER SPEEDLOADER

[76] Inventor: Duane M. Fehr, R.D. 2, Box 2350, Stroudsburg, Pa. 18360

[21] Appl. No.: 586,727

[22] Filed: Mar. 6, 1984

[51] Int. Cl.[4] ..... A45F 5/00

[52] U.S. Cl. ..... 224/253; 224/914

[58] Field of Search ..... 224/252, 253, 919, 239, 224/250, 914; 215/224, 274; 42/89

[56] References Cited

U.S. PATENT DOCUMENTS

| | | | |
|---|---|---|---|
| D. 203,101 | 12/1965 | Holder | 224/252 |
| 527,166 | 10/1894 | Watson . | |
| 2,396,184 | 12/1943 | Lima . | |
| 2,399,904 | 3/1943 | Baucum . | |
| 3,398,848 | 8/1968 | Donovan | 215/224 |
| 3,664,560 | 5/1972 | Perkins . | |
| 3,756,299 | 9/1973 | Simmons et al. | 224/919 |
| 3,769,733 | 11/1973 | Nelson . | |
| 3,890,733 | 6/1975 | Kubik . | |
| 3,938,717 | 2/1976 | Theodore . | |
| 4,194,657 | 3/1980 | Thor . | |
| 4,272,903 | 6/1981 | Griffis . | |

*Primary Examiner*—Stephen Marcus
*Assistant Examiner*—David Voorhees
*Attorney, Agent, or Firm*—Finnegan, Henderson, Farabow, Garrett & Dunner

[57] ABSTRACT

A carrier for a revolver speedloader in which a base section has a pair of spaced apart slots adopted to receive a loop of thistle cloth. That portion of the thistle cloth loop exterior to the back section may be used to attach the carrier to the belt of the wearer, while a small section of thistle cloth is fixed to the outside surface of a speedloader to permit the speedloader to be removably secured against the interior surface of the back section by cooperation with the portion of the thistle cloth strip passing between the slots. A base section extends outwardly from the bottom of the back section and has a protuberance extending upwardly a sufficient height and located from the junction of the base and back sections of sufficient distance to capture tips of cartridges of a loaded speed loader which is so secured against the back section.

12 Claims, 14 Drawing Figures

Fig. 1
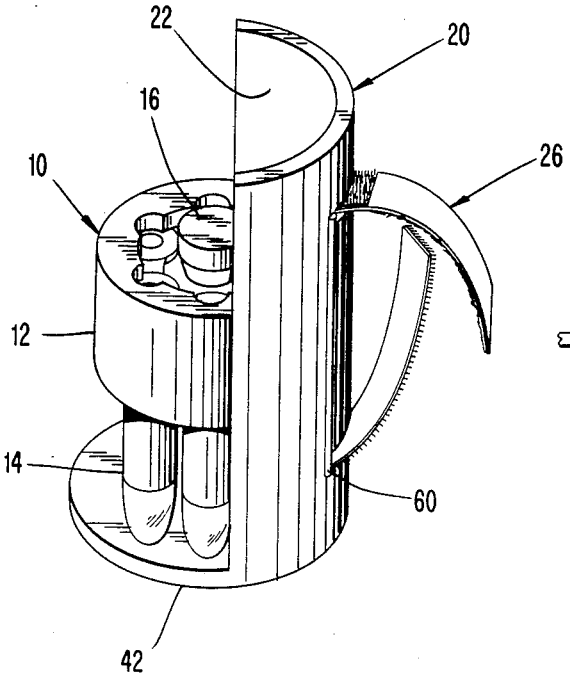
Fig. 9
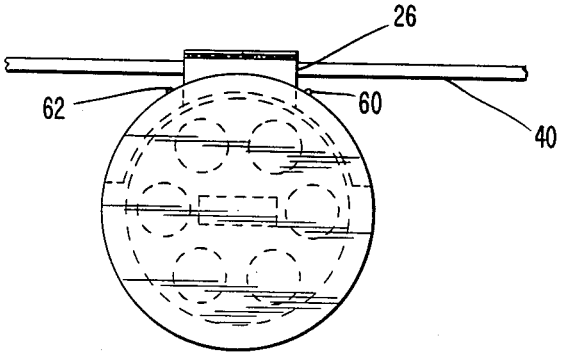
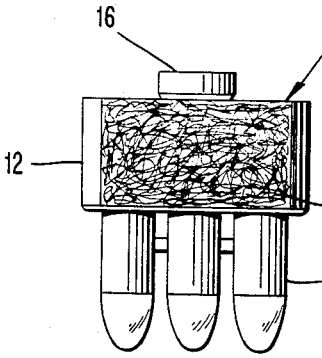
Fig. 2
Fig. 7
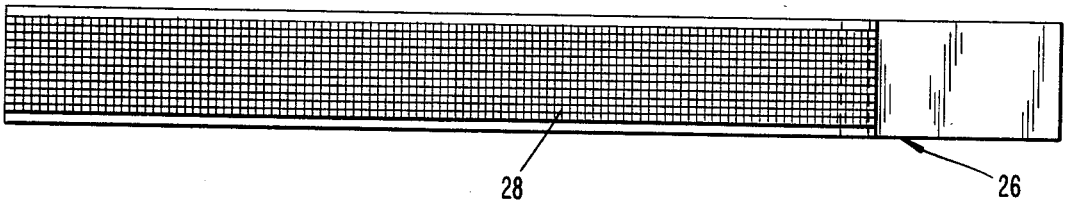
Fig. 8
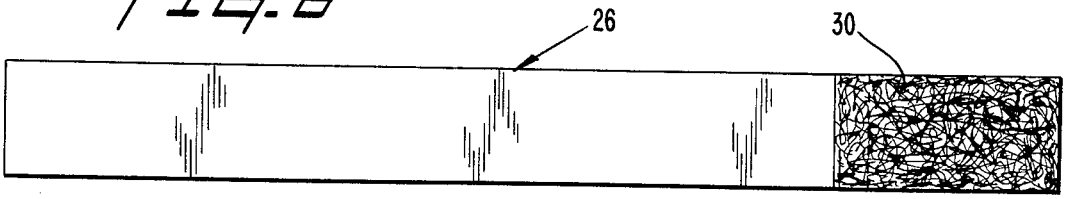

Fig. 3
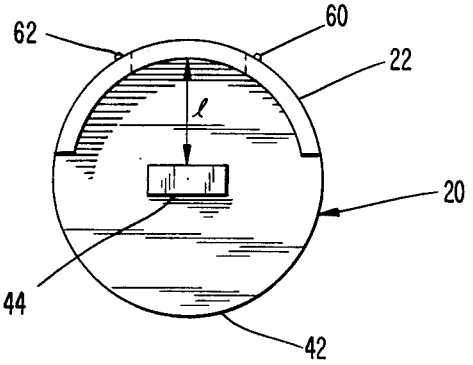
Fig. 4
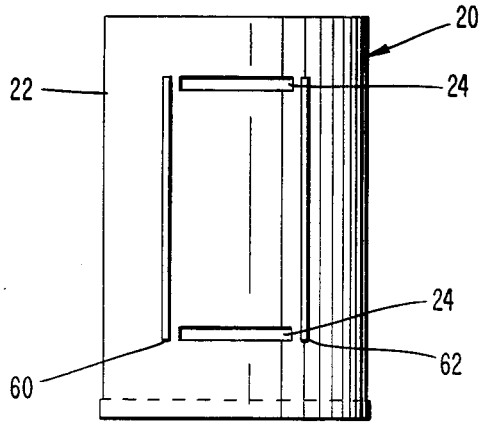
Fig. 5
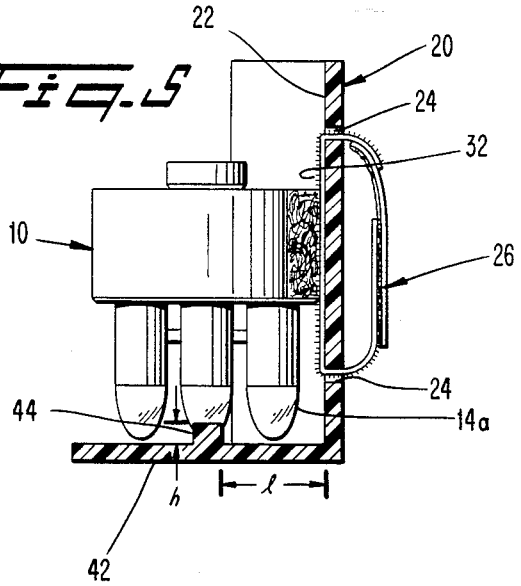
Fig. 10
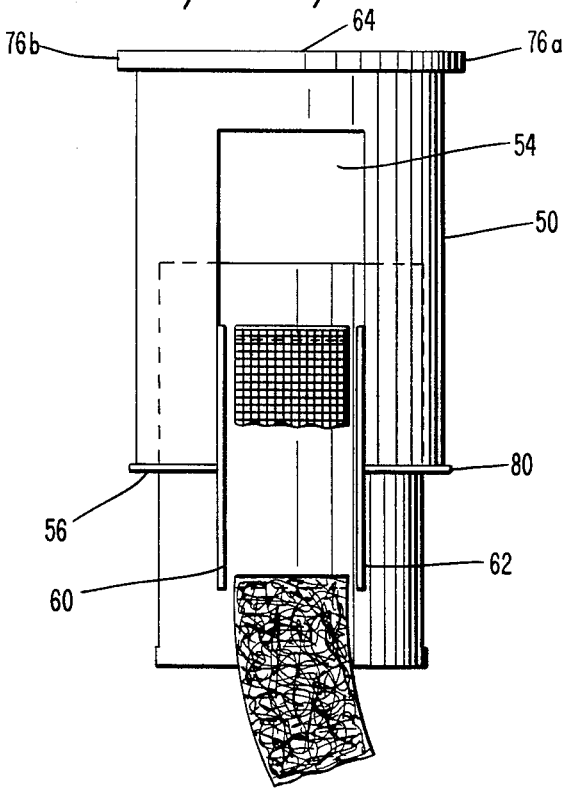
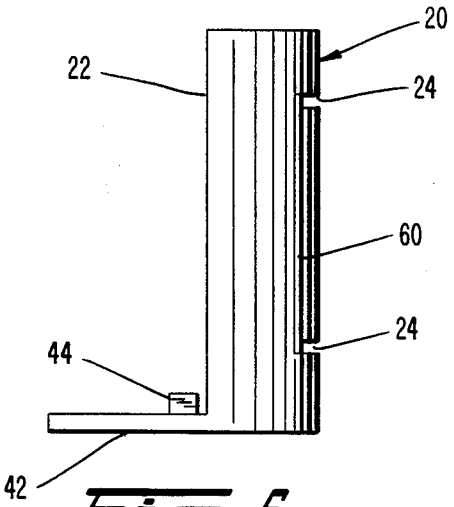
Fig. 6

Fig. 11
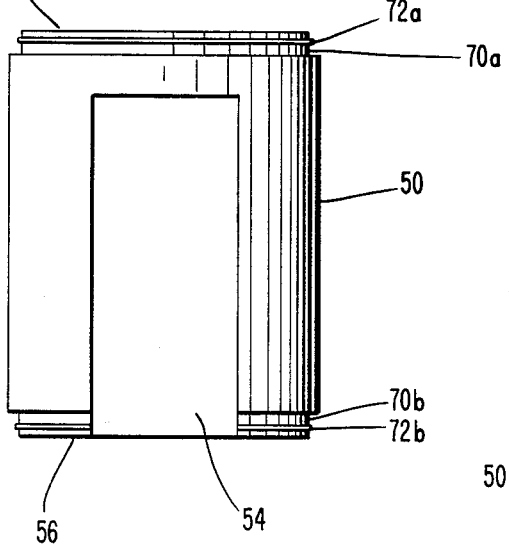
Fig. 12
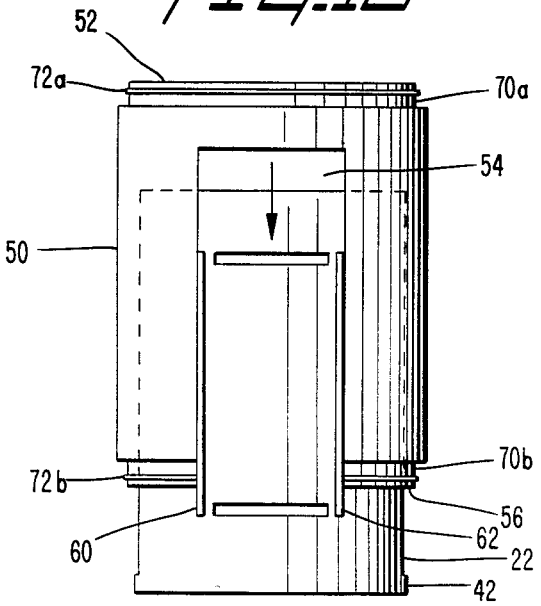
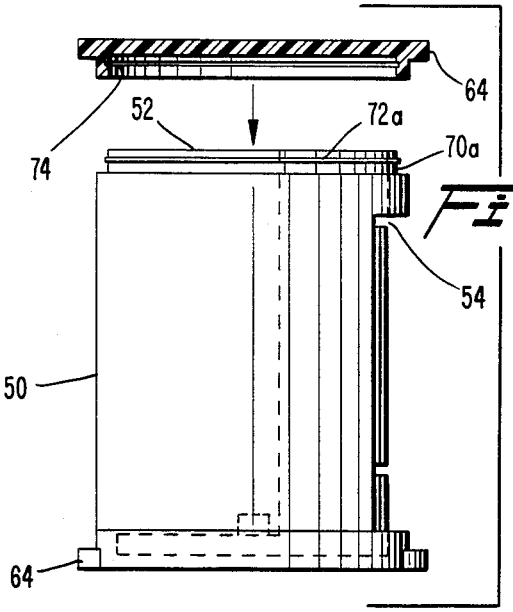
Fig. 13
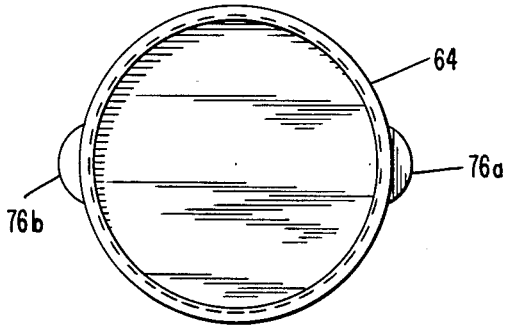
Fig. 14

CARRIER FOR A REVOLVER SPEEDLOADER

BACKGROUND OF THE INVENTION

I. Field of the Invention

The present invention relates to a device for holding or carrying a revolver speedloader and for permitting quick access to that revolver speedloader.

II. Description of the Prior Art

A revolver speedloader is a device for holding a plurality of cartridges in a manner which permits these cartridges to be quickly inserted into cartridge chambers of a revolver cylinder. Specifically, a speedloader typically comprises a body with a plurality of cartridge chambers aligned in a configuration which corresponds to the configuration of the cartridge chambers in the revolver cylinder. The speedloader has a release mechanism which permits all of the cartridges to be quickly released from the chambers in the speedloader body and inserted into the chambers of the revolver cylinder.

Holders or carriers exist in the prior art which provide some degree of capability to store such a speedloader in a readily accessible location, such as on a user's belt, in a manner which permits the speedloader to be simply and quickly removed from the carrier.

One such carrier is disclosed in U.S. Pat. No. 3,890,733 issued to Kubik. The Kubik patent discloses a contoured enclosure-type carrier having a bracket means to receive a speedloader. The bracket means includes a bracket arm extending outwardly from a rear wall of the holder. The speedloader itself must be fitted with a spring member opposite an upper surface of the speedloader. When in position in the carrier, the speedloader is held fast by capturing the bracket arm between the spring member and the upper surface of the speedloader. To maintain the speedloader in this position, the bracket arm is required to have a small aperature and the spring member is required to have a downward extending teat which is received in the bracket arm aperture. Application of a slight downward pressure on the upper portion of the speedloader is reported to disengage the teat from the aperture permitting the speedloader to be removed from the carrier.

Such prior art carriers have the disadvantage of requiring a speedloader of specific construction, namely a speedloader with a spring member capable of engaging the carrier bracket arm. Standard speedloaders without such a spring member may not be employed.

The prior art also provides a simple pouch for holding a standard speedloader. To gain access of a speedloader from such a pouch, the pouch must be opened, and the user's fingers must be inserted into the pouch to grasp hold of the speedloader, a maneuver which, if not perfectly executed, may result in loss of precious time. In any event, access to a speedloader from a pouch, even if perfectly executed, is typically not as rapid as access from a carrier such as that disclosed in the Kubik patent.

It is, accordingly, an object of the present invention to provide a carrier which can be used with a standard revolver speedloader and yet permit extremely rapid access to that speedloader.

More specifically, it is an object of the present invention to provide a carrier for a standard speedloader in which the speedloader is properly positioned to be gripped, withdrawn from the holder, and then used to insert ammunition into a revolver in substantially one motion.

Additional objects and advantages of the invention will be set forth in part in the description which follows, and in part will be obvious from the description or may be learned by practice of the invention.

SUMMARY OF THE INVENTION

To achieve the foregoing objects, and in accordance with the purposes of the invention as embodied and broadly described herein, a carrier for a revolver speedloader is provided which comprises: (a) a back section having a pair of spaced apart slots; (b) a cloth strip passing through the slots, the strip having thistle cloth coarse and fleece sections to permit a closed loop to be formed by the strip, and the strip including means, located on that portion of the strip between the slots, for holding a speedloader body against the back section of the carrier; (c) a base section extending outwardly from the back section, the base section having a protuberance extending upwardly a sufficient height, and located from the junction of the base and back sections a sufficient distance, to capture the tips of cartridges of a loaded speedloader which is held fast against the back section by the means for holding. Preferably, the means for holding includes a section of thistle cloth of coarse or fleece variety on the cloth strip between the slots, with an opposite variety thistle cloth glued onto an exterior body surface of a standard speedloader, permitting that standard speedloader to be carried in according with the teachings of the present invention.

The back section of the subject invention preferably has an interior surface shaped to correspond to an exterior surface of the speedloader body. For example, if the exterior surface of the speedloader body is cylindrical, the back section preferably comprises an open cylindrical tubing section, and the base section is circular in shape with the same diameter as the diameter of the open cylindrical tubing section.

It is also preferable that the subject invention include a cover which comprises a hollow cylinder closed at one end, and having an internal diameter sufficiently greater than the external diameter of the base section to permit the cover to slide over the back and base sections. The cover has a slot extending from the open end of the cylinder to permit the cover to pass by the cloth strip.

The carrier of the subject invention also preferably includes a cap, and the cover includes first means for securing the cap to the open end of the cylinder when the cover is in place over the back and base sections, whereby the cap holds the cover in place. Second means for securing may be provided at the closed end of the cylinder, whereat the cap may be stored as the cover is being removed from the back and base sections. Both means for securing preferably comprise a ring extending around the exterior surface of the cylinder at each end of the cylinder. The exterior surface of the cylinder preferably is offset where the rings are located in order to permit the cap to lie flush with the non-offset exterior surface of the cylinder when the cap is in place.

BRIEF DESCRIPTION OF THE DRAWINGS

FIG. 1 is a perspective view of a carrier incorporating the teachings of the invention;

FIG. 2 is a side view of a speedloader used in accordance with the teachings of the subject invention;

FIG. 3 is a top view of the carrier of FIG. 1;

FIG. 4 is a back view of the carrier of FIG. 1;

FIG. 5 is a cutaway side view of the carrier of FIG. 1 with speedloader in place;

FIG. 6 is a side view of the carrier of FIG. 1;

FIG. 7 illustrates one side of a flexible strip employed with the carrier of FIG. 1;

FIG. 8 shows the other side of the flexible strip illustrated in FIG. 7;

FIG. 9 is a top view of the carrier of FIG. 1 with cover in place;

FIG. 10 is a side view of the carrier of FIG. 1 with cover partly in place;

FIG. 11 is a side view of another cover used in connection with the carrier of FIG. 1;

FIG. 12 is the side view of the cover of FIG. 11 partially in place;

FIG. 13 is another side view of the cover of FIG. 12;

FIG. 14 is a top view of a cap used in connection with either the cover of the subject invention.

DESCRIPTION OF THE PREFERRED EMBODIMENT

Reference will now be made in detail to the present preferred embodiment of the subject invention as illustrated in the accompanying drawings.

A speedloader 10 is shown in FIGS. 1 and 2 to comprise a body 12 which is adopted to hold a plurality of cartridges 14 in a circular pattern. Specifically, body 12 includes a plurality of apertures into which cartridges 14 are inserted. As is known to those skilled in the art, speedloader 10 includes a latch mechanism 16 which permits cartridges 14 to be released from body 12 for simultaneous insertion into a plurality of revolver cylinder chambers.

As shown in FIGS. 1 and 2, speedloader 10 is of a standard variety with the outside surface of body 12 assuming a generally cylindrical shape. However, as shown in FIG. 2, a section of thistle cloth 18 is attached to a portion of the exterior surface of body 12. Thistle cloth 18, also known as Velcro TM, may be of either fleece or coarse variety. As is well known, the fleece and coarse varieties of thistle cloth attach to one another upon contact to hold fast together and are released from one another with the application of a substantial tug or pull.

In FIGS. 1, 3, 4, 5 and 6, a carrier 20 is illustrated which includes a back section 22. Back section 22 has an interior surface shaped to correspond to the exterior surface of speedloader body 12. More specifically, back section 22 is illustrated to comprise an open cylindrical tubing section, although it should be understood that the invention is not intended to be limited to this particular configuration. The interior surface of the back section preferably is shaped generally to correspond to an exterior surface of the speedloader body. This correspondence is preferred, as will be apparent below, in order to assure that the speedloader is held fast against the interior surface of the back section.

Back section 22 also includes a pair of spaced apart slots 24 which are adapted to receive a flexible thistle cloth strip 26. Slots 24 may be aligned parallel to a circumference of back section 22, or, in the alternative, may be aligned parallel to the longitudinal axis of back section 22.

Thistle cloth 26 is shown in FIGS. 7 and 8 to include a coarse section 28 on one side of strip 26, and a fleece section 30 on the other side of strip 26. Coarse section 28 and fleece section 30 are aligned on opposite sides to permit a closed loop to be formed by strip 26 once strip 26 is passed through slots 24. That portion of the closed loop formed by strip 26 which lies outside of back section 22 may be used to secure carrier 20 around a belt 40 (FIG. 9) or other strap carried by a user.

In accordance with the present invention, there is provided a flexible cloth strip which includes means located on that portion of the strip between the slots for holding a speedloader body against the back section. As illustratively shown in FIG. 5, a portion 32 of strip 26 lies between slots 24 on the interior surface of back section 22. On portion 32 there is located either a coarse or fleece section of thistle cloth of opposite variety to that of thistle cloth 18 on speedloader 10, which may be employed to hold speedloader 10 of FIG. 2 firmly against back section 22. Although so held firmly in place, speedloader 10 may be readily removed from back section 22 with a tug or pull sufficient to disengage the thistle cloth in section 32 from thistle cloth 18 on body 12 of speedloader 10.

Holder 20 further includes a base section 42 extending outwardly from a lower end of back section 22. Base section 42 may, as illustrated, be circular in cross section with the same diameter as the diameter of the cylindrical tubing forming back section 22. In effect, base section 42 is simply a bottom or platform for back section 22.

In accordance with the present invention, a protuberance is provided extending upwardly a sufficient height, and located from the junction of the base and back sections a sufficient distance to capture the tips of cartridges in a loaded speedloader which is held fast against the back section by the strip. As illustratively shown in FIGS. 3, 5 and 6, there is provided on base section 42 an upwardly extending protuberance 44. Protuberance 44 is located a distance "l" from the junction of base section 42 and back section 22. Protuberance 44 extends upwardly a height "h" from the upper surface of base section 42. With speedloader 10 held fast against back section 22 through the use of thistle cloth 18 and a complementary section of thistle cloth in portion 32 of strip 26, a cartridge **14*a* becomes located between protuberance 44 and back section 22. To permit this configuration, distance "l" should be just slightly greater than the width of cartridge 14*a*. In addition, height "h" of protuberance 44 should be slightly greater than the distance from the tip of cartridge 14*a* to the upper surface of base section 42. Accordingly, if speedloader 10 were to tend to swing outwardly away from back section 22 due to the orientation of carrier 20, protuberance 44 would act against the tip of cartridge 14*a*, thereby holding speedloader 10 in a trapped position within carrier 20. However, when required by the user, speedloader 10 may be easily accessed by simply grabbing hold of the exposed body 12 and issuing a tug of sufficient magnitude to disengage thistle cloth 18 from the complementary portion of thistle cloth in section 32 of strip 26**.

Since the only modification of speedloader 10 required to operate with carrier 20 is the application of a section of thistle cloth 18, carrier 20 may be readily employed with a standard speedloader, once a small section of thistle cloth has been applied to the exterior surface of the speedloader body.

Accordingly, the subject invention provides an extremely simple yet effective speedloader carrier in which a single flexible cloth provides the multiple functions of both holding the speedloader fast against a back section of the carrier and forming a loop through which a belt or other strip may pass by which the carrier may be secured to a user. The upwardly extending protuberance on the base section of the carrier assures that these dual functions may be achieved without any undesirable swinging of the carrier away from the back section as the carrier is jostled or reoriented due to user movement.

A cover for 50 is illustrated in FIGS. 10 through 14. Cover 50 preferably comprises a hollow cylinder which is closed at one end 52. The hollow cylinder of cover 50 has an interior diameter sufficiently greater than the exterior diameter of base section 22 to permit cover 50 to slide over back section 22 and base section 42 as shown in FIG. 12. Cover 50 has a slot 54 extending from the lower open end 56 of cover 50 to permit cover 50 to pass over flexible cloth 26. Ribs 60 and 62 are provided adjacent slots 24 to prevent cover 50 from rotating around back section 22.

A cap 64 is illustrated in FIGS. 10, 13 and 14. Cap 64 may be used to secure cover 50 in place over carrier 20. Specifically, cover 50 is provided at each end with an offset surface 70*a*, 70*b*. Circumferential ribs 72*a*, 73*b* are provided around offset surfaces 70*a*, 70*b*, respectively. Cap 64 has a circumferential indent 74 (FIG. 13) adapted to correspond to ribs 72*a*, 72*b*. Accordingly, cap 64 may be positioned on offset surface 70*a* or 70*b* and held in place by corresponding ribs 72*a*, 72*b*. When located on offset surface 70*b* at the lower end of housing 50, cap 64 operates to hold housing 50 in place over carrier 20. In order to avoid loss of cap 64 during removal of cover 50, cap 64 may be locked onto upper ring 72*a* of housing 50. Housing 50 can then be removed from carrier 22 exposing readily accessible speedloader 10.

With the use of offset surfaces 70*a*, 70*b*, the exterior circumference of cap 64 is preferably selected to correspond with the diameter of the exterior surface of carrier 50, leaving cap 64 flush to the outside surface of carrier 50. Tabs 76*a*, 76*b* permit cap 64 to be grasped by the user and snapped off of ring 72*b* to permit housing 50 to be removed from carrier 20. A ring 80 may be employed on the surface of cover 50 without the use of any offset surfaces as is shown in FIG. 10. In this instance, the outside diameter of cap 64 cannot, however, be made flush with the exterior surface of cover 50.

Additional advantages and modifications will readily occur to those skilled in the art. The invention in its broader aspects is not, therefore, limited to the specific details, representative embodiments and illustrative examples shown and described. Accordingly, departures may be made from such details without departing from the spirit or scope of applicant's general inventive concept.

What is claimed is:

1. A carrier for a revolver speedloader which has a body adapted to hold a plurality of cartriges parallel to one another in a circular pattern, said carrier comprising:

a. a back section having a pair of spaced apart slots;

b. a flexible strip passing through said slots, said strip having course and fleece thistle cloth sections to permit a closed loop to be formed by said strip, and said strip further including means, located on that portion of said strip between said slots and between said speedloader body and said back section, for holding said speedloader body against said back section; and c. a base section extending outwardly from said back section, said base section having a protuberance extending upwardly a sufficient height, and located from the junction of said base and back sections a sufficient distance, to capture tips of cartridges of a loaded speedloader which is held fast against the back section by said means for holding.

2. A carrier of claim 1 wherein said means for holding includes a coarse section of thistle cloth.

3. A carrier of claim 1 wherein said means for holding includes a fleece section of thistle cloth.

4. A carrier of claim 1 wherein said back section has an interior surface shaped to correspond to an exterior surface of said speedloader body.

5. A carrier of claim 1 wherein said back section is an open cylindrical tubing section.

6. A carrier of claim 5 wherein said base section is circular in shape and has the same diameter as the diameter of said open cylindrical tubing section.

7. A carrier of claim 6 further including a cover which comprises a hollow cylinder closed at one end, said cylinder having an interior diameter sufficiently greater than the exterior diameter of said base section to permit said cover to slide over said back and base sections, said cover having a slot extending from the open end of said cylinder to permit said cover to pass by said flexible strip.

8. The carrier of claim 7 wherein said carrier includes a cap and said cover includes first means for securing said cap to said open end of said cylinder when said cover is in place over said back and base sections, whereby said cap holds said cover in place.

9. The carrier of claim 8 wherein said cover includes second means for securing said cap to said closed end of said cylinder, whereat said cap may be stored as said cover is being removed from said back and base sections.

10. A carrier of claim 9 wherein said first and second means for securing each cap comprise a ring extending from the exterior surface of said cylinder, one adjacent the open end of said cylidner and one adjacent the closed end.

11. A carrier of claim 10 wherein the exterior surface of said cylinder is offset where said rings are located to permit said cap to lie flush with the non-offset exterior surface of said cylinder.

12. A carrier for a revolver speedloader, which has a body adaptd to hold a plurality of cartridges parallel to one another in a circular pattern comprising:

a. a section of thistle cloth attached to an exterior surface of said body of said speedloader;

b. a back section having a pair of spaced apart slots;

c. a flexible strip passing through said slots, said strip having coarse and fleece thistle cloth sections to permit a closed loop to be formed by said strip, and said strip further including a section of thistle cloth located on that portion of said strip between said slots and between said speedloader body and said back section which is complementary to that section of thistle cloth on the body of said speedloader, for holding said speedloader body against said back section; and d. a base section extending outwardly from said back section, said base section having a protuberance extending upwardly a sufficient height, and located from the junction of said base and back sections a sufficient distance, to capture tips of cartridges loaded into said speedloader when said loaded speedloader is held fast against said back section by said complementary section of thistle cloth.

* * * * *